United States Patent [19]

Trocino

[11] Patent Number: 4,634,480

[45] Date of Patent: Jan. 6, 1987

[54] METHOD OF COMBINING LIQUID EXPLOSIVE COMPOSITIONS FOR FIELD OPERATIONS

[76] Inventor: Joseph L. Trocino, 15233 Ventura Blvd., P-10, Sherman Oaks, Calif. 91403

[21] Appl. No.: 778,972

[22] Filed: Sep. 23, 1985

[51] Int. Cl.[4] ..... C06B 47/04

[52] U.S. Cl. ..... 149/74; 149/89; 149/109.6; 102/332; 102/705

[58] Field of Search ..... 149/74, 89, 109.6; 102/332, 705

[56] References Cited

U.S. PATENT DOCUMENTS 3,423,258 1/1969 Cross ..... 149/89

3,454,438 7/1969 Simpson et al. ..... 149/89

3,471,347 10/1969 Cross et al. ..... 149/89

4,411,718 10/1983 Trocino ..... 149/74

*Primary Examiner*—Stephen J. Lechert, Jr.

*Attorney, Agent, or Firm*—Roger A. Marrs

[57] ABSTRACT

A method of combining explosive compositions prepared from commercially available nitric acid and a common industrial solvent is disclosed herein which exhibits exceedingly high blasting strengths. The compositions are relatively more stable than conventional shaped charge explosives such as HMX or RDX and far less expensive. The compositions are transported separately to the blasting site where the compositions are combined in ambient temperature for immediate use.

10 Claims, 1 Drawing Figure

METHOD OF COMBINING LIQUID EXPLOSIVE COMPOSITIONS FOR FIELD OPERATIONS

BACKGROUND OF THE INVENTION

1. Field of the Invention

This invention relates, generally, to a method of preparation of blasting compositions and, more specifically, to the preparation of liquid explosive compositions from sensitized nitroparaffins at the blasting site which may be utilized in numerous applications requiring personal safety and high blasting efficiency.

2. Brief Description of the Prior Art

There have been numerous attempts to provide explosive or blasting compositions, for industrial and military applications, that exhibit high blasting efficiencies with a minimum risk of injury to the users. Factors such as detonation sensitivity, shipment and storage of the compositions have tended to reduce the number of practical compositions that are commercially available. Conventional shaped charge explosives, such as HMX and RDX, are relatively expensive and are limited in their usefulness because they are solids.

Attempts to prepare liquid or semi-liquid blasting compositions from nitroalkanes have met with some success as illustrated in: U.S. Pat. No. 3,132,060; U.S. Pat. No. 3,133,844; U.S. Pat. No. 3,242,022; U.S. Pat. No. 3,44,728; and U.S. Pat. No. 3,454,438. However, in each instance, the patented composition have been limited in its usefulness because it was either too complex or it contained undesirable ingredients from a cost or availability point of view, it was so sensitive that it had to be mixed on site from ingredients that were transported separately in special equipment or, because of its composition, it was not capable of yielding a reproducible smooth uniform detonation front.

In particular, the U.S. Pat. No. 3,454,438 contains a disclosure of compositions which are not as useful as the present invention because the compositions are solid, non-flowable, too complex and not reliable. The compositions require exceedingly expensive ingredients, contain relatively hazardous materials or, because of their sensitivities, they are less safe to use.

Furthermore, the prior art compositions such as disclosed in U.S. Pat. No. 3,454,438 pertain to a gelled explosive which does not flow well and is, therefore, limited in use for handling small quantities of explosive such as sticks of dynamite. Gelled explosives are at a severe disadvantage when used in large quantities in atomic blast simulations or underground rock fracturing operations to release natural gas.

For large quantity usage, transportation hazards are encountered when mixed, non-gelled, liquid ingredients or compositions are involved. Thus, transportation of compositions separately is desirable with subsequent mixing on-site as a solution to the transportation hazard problem. However, in this latter instance, difficulties are incurred if the separate compositions are not combined according to specific quantity limitations such as the present invention sets forth. Thus, there is still a need for a new low cost, non-hazardous, efficient and reliable liquid explosive composition that can be transported in separate ingredients and blended on-site and used without special equipment.

SUMMARY OF THE INVENTION

Accordingly, the above problems and difficulties encountered with solid, gelled explosive compositions are obviated by the present inventive method that entails transporting separate large quantities of nitroethane and a commercial grade of nitric acid in selected proportions to yield low cost, stable, highly efficient, relatively safe and simple to prepare, liquid explosive compositions.

In the practice of one method of the invention, large liquid quantities of nitroethane and nitric acid are transported separately and individually from a storage location to an operational site where quantities are mixed together at the operational site resulting in a mixed two component liquid composition of the quantities immediately available for detonation by a separate and subsequent detonation.

It is a primary object of this invention to provide a method of using and mixing a readily flowable liquid explosive two component composition that contains low cost commercially available ingredients.

A further objective of this invention is to provide a liquid blasting composition which is not cap or shock sensitive and yields a uniformly smooth detonation front.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

DESCRIPTION OF THE PREFERRED EMBODIMENT

Figure 1:
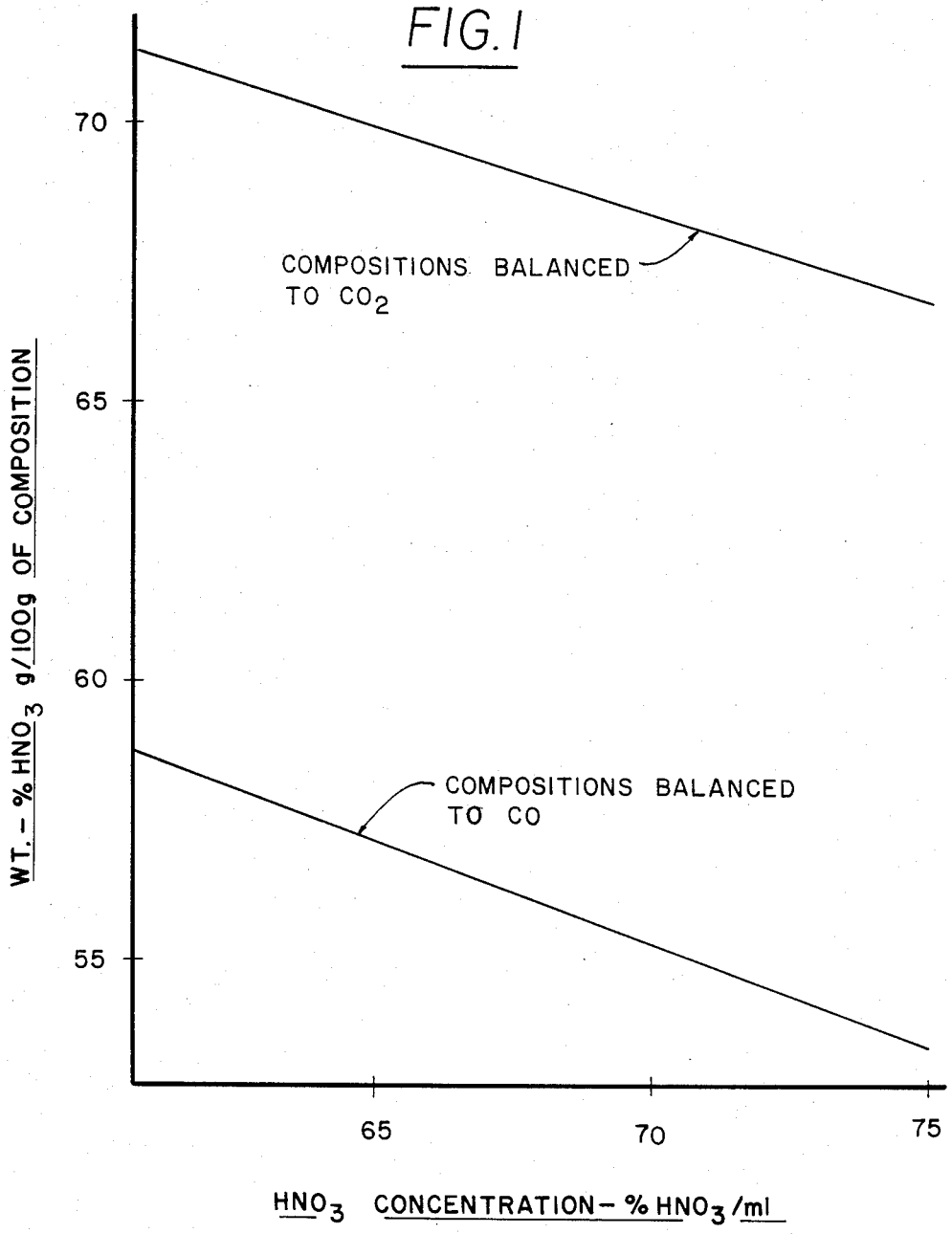
FIG. 1 is a plot diagram illustrating the weight of $HNO_3$, in grams, per 100 grams of blasting composition as a function of nitric acid concentration in aqueous $HNO_3$ solutions.

The novel two component explosive composition of my invention consists of a common industrial solvent, nitroethane, selectively sensitized with commercial grade nitric acid mixed together at an operational or using site.

Nitroethane is an industrial solvent that is available in abundant supply at low cost. The physical properties of nitroethane are such that it is inherently much safer to use than a large number of solvents commonly used in coatings. For example, its lower limit of flammability is 3.4% by volume in air as compared with 0.9%, 1.0% and 2.15% for methyl isobutyl ketone, xylene and acetone respectively. Similarly, its flash point (TCC) is 87° F. as compared to flash points of 0° F., 24° F. and 81° F. for acetone, methyl ethyl ketone and xylene respecively.

Commercial grade nitric acid is similarly an abundant, readily available low cost material. The nitric acid found to be useful as a sensitizer for nitroethane is aqueous nitric acid which contains from 60 to 75% nitric acid. It, as well as nitroethane, may be separately transported and shipped with little or no difficulty using ordinary precautions.

To prepare safe and usable explosive liquid mixtures so as to have a flowable mixture of nitroethane ($C_2H_5NO_2$) and nitric acid ($HNO_3$), I have discovered that the ratio of anhydrous $HNO_3$ to $C_2H_5NO_2$ within the composition must fall within the range of 0.839:1 and 1.511:1. These ratios are easily prepared at the using operation site by selectively blending $C_2H_5NO_2$ with commercially available aqueous $HNO_3$ containing from 25 to 40% water.

The most effective compositions are obtained when the ratio of $HNO_3$ to $C_2H_5NO_2$ is such that the combustion product yields carbon dioxide as opposed to carbon monoxide. For example, $$C_2H_5NO_2+1.8HNO_3 \rightarrow 2CO_2+3.4H_2O+1.4N_2 \quad (1).$$

However, compositions containing a $HNO_3$:$C_2H_5NO_2$ ratio which yields a combustion product containing carbon monoxide, i.e., $$C_2H_5NO_2+1HNO_3 \rightarrow 2CO+3H_2O+1N_2 \quad (2)$$

are also useful.

The amount of $HNO_3$ per 100 grams of composition required to yield the combustion products of equations (1) and (2) may be selected from the curves in FIG. 1 if the concentration or density of the acid solution is known. For example, using a commercially available $HNO_3$ solution containing 65% $HNO_3$, one would either blend 69.9 grams or 56.4 grams of the solution with 30.1 grams or 43.6 grams of $C_2H_5NO_2$ respectively depending upon whether the mixture is to be balanced to $CO_2$ or to CO. Compositions balanced to $CO_2$ are more sensitive and exhibit higher detonation velocities than compositions balanced to CO.

In practice, one mixes the proper weight of $HNO_3$ and $C_2H_5NO_2$ in a clean container as the explosive composition is needed at this using site. Nitroethane is totally miscible in aqueous nitric acid solutions over a wide temperature range so long as the acid content of solution is at least 60%. Nitroethane is immiscible with $HNO_3$ in concentrations less than 58% acid. Above 75.0% acid, the advantages of the compositions, insofar as safety factors are concerned, are lost because the sensitivity of the compositions increase dramatically.

Selected compositions, balanced to $CO_2$, are shown below for five acid solutions.

TABLE 1

| Nitroethane-Nitric Acid Compositions Balanced to $CO_2$ | | | | | |
|---|---|---|---|---|---|
| | Acid Concentration, % $HNO_3$ | | | | |
| Ingredient | 60.0% | 63 | 65 | 70 | 75 |
| $C_2H_5NO_2$, wt % | 28.42 | 29.42 | 30.08 | 31.65 | 33.16 |
| $HNO_3$, wt % | 71.58 | 70.58 | 69.92 | 68.35 | 66.84 |
| GAP(1) | | | 0.49 | .95 | |
| DV(2) | | | 6513 | 6645 | |

(1)Gap sensitivity test 50% "go" thickness in inches. HMX is 2.8 inches and RDX is 2.7 inches, when pressed to a density of 1.1 g/sec.
(2)Detonation velocity, meters per second. Nitromethane = 6200 m/sec while RDX detonates with a velocity of 7960 m/sec.

It is understood, by those skilled in the art, that there is water in each of the compositions shown in Table 1. Should one recalculate the anhydrous acid content, the following specific concentrations would be apparent:

TABLE 2

| Nitroethane-Nitric Acid Compositions | | | | |
|---|---|---|---|---|
| | Acid Concentration, % $HNO_3$ | | | |
| Ingredient | 60 | 65 | 70 | 75 |
| $C_2H_5NO_2$, wt % | 28.42 | 30.08 | 31.65 | 33.16 |
| $HNO_3$, wt %(1) | 42.95 | 45.45 | 47.85 | 50.13 |

TABLE 2-continued

| Nitroethane-Nitric Acid Compositions | | | | |
|---|---|---|---|---|
| | Acid Concentration, % $HNO_3$ | | | |
| Ingredient | 60 | 65 | 70 | 75 |
| $H_2O$, wt % | 28.63 | 24.47 | 20.51 | 16.71 |

(1)Anhydrous $HNO_3$. Similarly, the specific composition of mixtures balanced to CO are shown in the following table:

TABLE 3

| CO Balanced Nitroethane-Nitric Acid Compositions | | | | |
|---|---|---|---|---|
| | Acid Composition, % $HNO_3$ | | | |
| Ingredient | 60 | 65 | 70 | 75 |
| $C_2H_5NO_2$, wt % | 41.68 | 43.63 | 45.46 | 47.18 |
| $HNO_3$, wt %(1) | 35.0 | 36.64 | 38.18 | 39.62 |
| $H_2O$, wt % | 23.33 | 19.73 | 16.36 | 13.20 |

(1)Anhydrous $HNO_3$.

The simplicity of this invention is apparent from the above teachings. Inasmuch as the total number of components, within any mixture, is reduced to two components, there is little or no chance for blending mistakes by operators using the compositions under field conditions. The relatively insensitivity of the components of the composition makes transportation and shipment to the operational site a simple task. The three component explosive disclosed in U.S. Pat. No. 3,454,438 is solid and will now flow. The prior patent emphasizes that a two component composition is dangerous, is to be avoided and is a severe disadvantage. By employing the liquid nitroethane and nitric acid with ratio ranges specified, these problems are overcome and the solid feature of the prior patent composition is completely avoided. The inventive composition and method of blending together at operation site of two liquid ingredients results in a safe and usable liquid explosive composition without the expense or incorporation of a third or more ingredients. The prior patent mentioned above does not recognize the two component liquid composition as being capable of performing the purposes and functions of the inventive composition and method of production.

The method utilizes the steps of gathering the nitroethane in one place and the nitric acid in another for storage purposes while transporting and shipping these components or ingredients separately to an operational site at the site where specific quantities of each ingredient is blended or mixed according to specific ratios within a range so that a totally liquid flowable and safe explosive composition ensues. Therefore, having disclosed the nature of my invention, and having provided teachings to enable others to make and use the same, the scope of my claims may now be understood.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. In a completely liquid and flowable explosive composition for use and mixture at the field operational site, the improvement consisting of:

28.4% to 47.18% nitroethane blended at the operation site with 53.82% to 71.6% nitric acid wherein said nitric acid contains from 25.0% to 40.05% water.

2. A flowable composition in accordance with claim 1 wherein:

28.4% to 41.7% nitroethane is blended with 58.3% to 71.6% nitric acid wherein said acid contains 40.0% water.

3. A flowable composition in accordance with claim 1 wherein:

33.2% to 47.2% nitroethane is blended with 52.8% to 66.8% nitric acid wherein said acid contains 25.0% water.

4. In an inexpensive, stable liquid and flowable explosive for use in field operations to be mixed at a specific site, the improvement consisting of:

28.4% to 47.2% liquid nitroethane mixed with 35.0% to 50.1% liquid nitric acid and 13.2% to 28.6% water, wherein said nitric acid is anhydrous nitric acid and said nitroethane and said nitric acid are separate ingredients mixed at said field operational site.

5. A composition of claim 4 wherein:

41.7% to 47.2% nitroethane is blended with 35.0% to 39.6% nitric acid and 13.2% to 23.3% water.

6. A composition of claim 4 wherein:

28.4% to 33.2% nitroethane is blended with 42.9% to 50.1% nitric acid and 16.7% to 28.6% water.

7. A method of preparing a flowable explosive composition from only two liquid components comprising the steps of:

selecting a first liquid component consisting of 28.4% to 41.7% nitroethane;

selecting a second liquid component consisting of 58.3% to 71.6% nitric acid which includes 40.0% water;

blending said first and second liquid components together for immediate use in field operations at a specific site; and detonating said blended two liquid component explosive composition at said specific site by a separate and individual detonation.

8. The method in accordance with the steps of claim 7 after the selection steps includes the step of:

transporting and shipping said selected liquid components in separate containers to said specific operational site preparatory to said step of blending.

9. The method in accordance with the steps of claim 8 wherein said step of blending occurs at ambient temperature and is followed by the step of pouring said blended two liquid component explosive composition into openings and crevices in the terrain at said specific operational site so that it flows and occupies the openings and crevices preparatory to said step of detonation.

10. The method in accordance with the steps of claim 9 wherein:

said detonation step is other than by shock or cap sensitive means.

* * * * *